United States Patent [19]

Weigl

[11] 4,269,431

[45] May 26, 1981

[54] SAFETY SKI BINDING

[75] Inventor: Erwin Weigl, Brunn am Gebirge, Austria

[73] Assignee: TMC Corporation, Baar, Switzerland

[21] Appl. No.: 13,475

[22] Filed: Feb. 21, 1979

[30] Foreign Application Priority Data

Feb. 23, 1978 [AT] Austria ..... 1300/78

[51] Int. Cl.[3] ..... A63C 9/08

[52] U.S. Cl. ..... 280/618

[58] Field of Search ..... 280/618, 617, 613, 636, 280/620, 607, 627, 611

[56] References Cited

U.S. PATENT DOCUMENTS

| | | | |
|---|---|---|---|
| 2,383,064 | 8/1945 | Lanz | 280/618 |
| 2,534,038 | 12/1950 | Lanz | 280/618 |
| 3,797,839 | 3/1974 | Smolka et al. | 280/607 X |
| 3,797,844 | 3/1974 | Smolka et al. | 280/617 |
| 3,937,480 | 2/1976 | Korger | 280/618 |
| 4,033,603 | 7/1977 | Horn | 280/618 |
| 4,073,509 | 2/1978 | Gertsch | 280/618 |

FOREIGN PATENT DOCUMENTS

| | | | |
|---|---|---|---|
| 2221105 | 11/1972 | Fed. Rep. of Germany . | |
| 2324078 | 11/1974 | Fed. Rep. of Germany | 280/617 |
| Ad.90223 | 9/1967 | France | 280/614 |

*Primary Examiner*—John J. Love
*Assistant Examiner*—Milton L. Smith
*Attorney, Agent, or Firm*—Blanchard, Flynn, Thiel, Boutell & Tanis

[57] ABSTRACT

A safety ski binding with a sole plate having structure facilitating a connection of a ski boot thereto. The two ends of the sole plate each engage a ski-fixed holding part and, through the provision of a locking mechanism prevents the sole plate from rotating and lifting off from the ski in the area of the ends of the sole plate. The sole plate is rotably supported approximately in its center about a ski-fixed pin which extends perpendicularly with respect to the upper surface of the ski and the pin is received in a recess in the sole plate and has structure for preventing removal of the sole plate. A sleeve is provided between the exterior surface of the pin and the interior wall of the recess in the sole plate, which sleeve is movable telescopically along the wall of the recess, and the maximum path of movement of the sleeve in the recess is fixed by stops.

9 Claims, 7 Drawing Figures

1a
1
2b
2
10
2c
2a

SAFETY SKI BINDING

FIELD OF THE INVENTION

The invention relates to a safety ski binding comprising a sole plate for receiving a ski boot thereon, which sole plate engages with its two ends each on a ski-fixed holding part, is held against rotation by a spring-loaded locking mechanism, and is rotatably supported approximately in its center about a ski-fixed, vertically extending pivot pin and at the same time is secured against loss.

BACKGROUND OF THE INVENTION

A rotatably supported plate of the abovementioned type is described for example in GERMAN OS No. 2,324,078. In this known construction, the sole plate consists of a base plate which is on the side of the ski and a sole plate which is on the side of the boot. The space between the plates is protected by an expandable sleeve against external influences. The two plates are connected by a bearing, the vertical axis of rotation of which extends through the axis of the shin and the horizontal axis of rotation of which lies transversely with respect to the longitudinal direction of the ski in a plane in the vertical axis. The vertical support is for the friction reduction constructed as a ball bearing, while the horizontal support consists in the form of a friction bearing of bolts and tetrapolyethylene-fluoride sleeves.

The just-described embodiment of the known device permits one to recognize at the same time the first disadvantage of this solution, which lies in the use of many structural parts, and also the sole plate has to have a special design. The use of many structural parts is not only expensive, also the sources for errors increase and the frictional forces which must be overcome increase. A further disadvantage consists in the structural parts which determine the position of the vertical pivot axis not permitting any play for absorbing tension forces, which are created by a bending or flexing of the ski, for example during skiing over a depression. Furthermore, it is absolutely necessary that the sole plate can pivot also about an additional horizontal axis.

According to Austrian Pat. No. 330,632, which corresponds to U.S. Pat. No. 4,033,603, it is also known to use one single pin or swivel part, wherein the pivot pin permits the sole plate to carry out both a limited pivoting in the horizontal and also in the vertical plane, before a release operation takes place. The pivot pin serves mostly to center and position the sole plate.

It is already known from Austrian Pat. No. 299,030, which corresponds to U.S. Pat. No. 3,797,839, to balance the bend or flex in the ski by rigidly connecting the plate to the ski at a fastening point. However, this design does not permit a swivelling of the sole plate in relationship to the ski, so that a spring-loaded locking mechanism cannot be used, which could control the release operations during a twisting fall and partly during a digonal fall, as this is possible for example in the aforementioned construction according to Austrian Pat. No. 330,632 and is also realized in the case of the subject matter of the invention. The solution according to Austrian Pat. No. 302,130, which corresponds to U.S. Pat. No. 3,797,844, in which the plate is held between two bearing points in a continuous spacing from the upper surface of the ski, can also not be used for a similar reason.

In order to be complete further reference is made to Austrian Pat. No. 326,015, which corresponds to U.S. Pat. No. 3,937,480, in which a plate is held pivotally about a pivot pin and rotatably with respect to a spring-loaded locking mechanism in the downhill skiing position. This known solution does not exceed what has been described in Austrian Pat. No. 330,632 and does not exceed the above-discussed state of the art.

The goal of the invention is to avoid the mentioned and further disadvantages of known constructions and to provide a sole plate of the abovementioned type as insensitive as possible to a bending or flexing of the ski.

The set purpose is inventively attained by the pivot pin being constructed as a telescoping pin having an annular flange, which flange is positioned through a sleeve in a recess of the sole plate, which recess is open on top and limits its vertical movement. Through the inventive construction of the pivot pin as a telescopic structural part and of the recess it is possible to absorb a considerably greater amount of bending or flexing of the ski than has been possible, without causing the ski boot to jam in the ski binding, since the sole plate behaves during a bending of the same like a chord with respect to an arc.

Further details, advantages and characteristics of the invention will be described more in detail with reference to the drawings, which illustrate two exemplary embodiments.

DETAILED DESCRIPTION

The type of fastening utilized to secure the ski boot to the sole plate, and the construction of the locking mechanism and the guiding thereof through a bent holding profile holding the toe of the sole plate to the ski are actually known and are not part of the subject matter of the present invention. For example, refer to U.S. Pat. No. 4,033,603. Therefore, these components will not be described in more detail.

A sole plate 2 with a locking mechanism **2*a* and the associated guide parts 2*b* is supported for a limited amount of pivotal movement by an inventive telescoping pin construction 3 and for movement which is relative to the holding part 2*c* secured to a ski 1. The axis of the telescoping pin construction extends perpendicularly to the upper surface 1***a* of the ski. The sole plate 2 is designed approximately twice as thick in the region of the telescoping pin 3 as the remaining part of the sole plate 2, the under surface of which extends parallel with respect to the upper surface of the ski.

Figures 1, 2, 3:
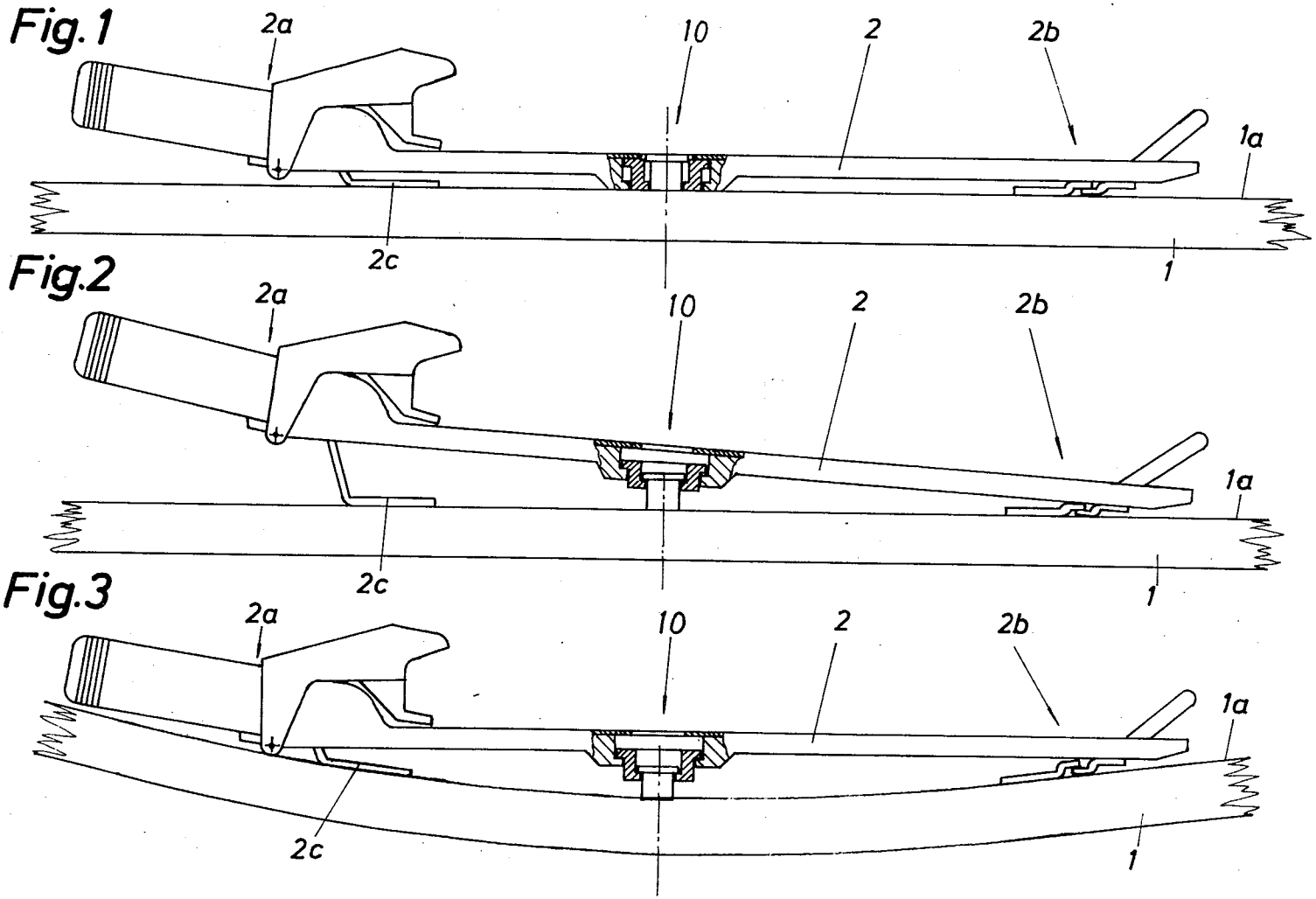
FIG. 1 illustrates a structure embodying a substantially common sole plate binding having an inventive telescoping pin construction, particularly when no forces act from outside on the ski or on the sole plate binding.
FIG. 2 illustrates one end of the sole plate binding lifted off from the ski and the telescoping pin in the extended position.
FIG. 3 illustrates the behavior of the inventive telescoping pin during a bending or flexing of the ski due to external forces applied to the ski.
Figure 4:
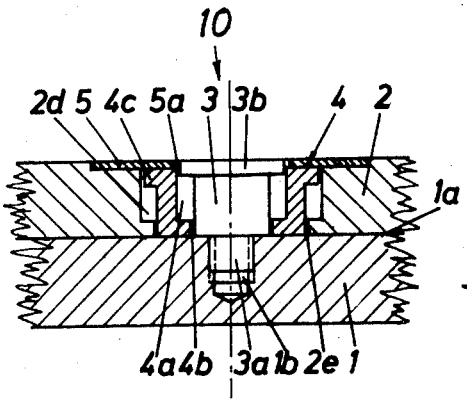
FIG. 4 illustrates a telescoping pin, as it is illustrated in FIGS. 1 to 3 in the retracted or non-operated position.

Details of the telescoping pin construction 10, which are illustrated in FIGS. 1 to 3 will now be described more in detail with reference to FIGS. 4 and 5. The ski has, starting from its upper surface 1*a*, a vertically extending tapped or threaded hole 1*b* which extends into the ski 1 up to approximately two-thirds of its thickness. A threaded bolt 3 having an external thread 3*a* thereon is screwed into the tapped hole 1*b*. The body of the bolt 3 is approximately twice the diameter of the threaded portion 3*a* and has at its upper end an annular flange 3*b*.

A telescoping part, namely a cup shaped sleeve 4 is supported for limited sliding movement relative to the bolt 3 in the vertical direction on the upper surface 1*a* of the ski. As can be seen from the drawing, the body of the bolt 3 is a substantially cylindrical member. Starting at its end remote from the upper surface 1*a* of the ski, the cup shaped sleeve 4 has a recess 4*a* therein concentric with the axis of the bolt 3. The diameter of the recess 4*a* is slightly larger than the diameter of the annular flange 3*b*. A further opening 4*b* concentric with the axis of the bolt 3, the diameter of which is slightly larger than the diameter of the body portion of the bolt 3, extends through the bottom wall of the recess 4*a* in the sleeve 4. The sleeve 4 has on its outside at the end thereof remote from the upper surface of the ski 1 an annular rim 4*c*, the height above the upper surface of the ski of which corresponds approximately with the height of the annular flange 3*b* on the bolt 3.

The telescoping pin construction 10 extends perpendicularly through the sole plate 2. The sole plate 2 has a recess 2*d* therein for this purpose, the diameter of which recess is slightly larger than the diameter of the annular rim 4*c* on the sleeve 4. The bottom wall of the recess in the sole plate 2 has an opening 2*e* concentrically extending therethrough. The diameter of the opening 2*e* is also slightly larger than the outside diameter of the sleeve 4. The recess 2*d* in the sole plate 2 is closed off by a circular disk 5, the diameter of which is larger than the diameter of the recess 2*d*, and the upper surface thereof is flush with the upper surface of the sole plate 2. The disk 5 has a concentric opening 5*a* therein, the diameter of which corresponds approximately with the diameter of the recess 4*a* in the sleeve 4.

Figure 5:
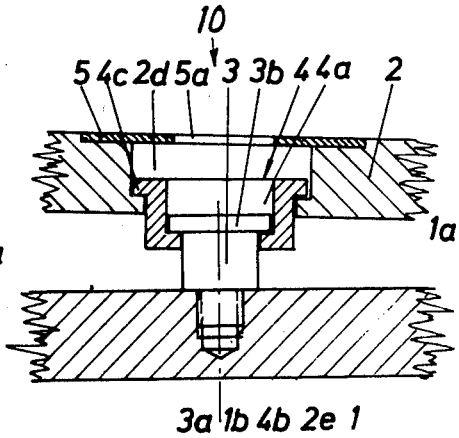
FIG. 5 illustrates the telescoping pin in the extended or operated position.

FIG. 5 illustrates the position of the above-described structural parts when an external force is applied onto the ski 1, as it will generally occur during travelling through a depression (see FIG. 3). The ski 1 is bent or flexed and the sole plate 2 behaves like the chord of an arc and lifts off from the ski 1 without operating the sleeve 4 until the bottom of the recess 2*d* engages the annular rim 4*c* of the sleeve 4 at which time the sleeve 4 is lifted off from the ski. This lifting-off movement goes on unhindered until the bottom of the recess 4*a* in the sleeve 4 engages the annular flange of the bolt 3.

The sole plate 2 remains in this end or raised position only until the external force no longer acts onto the ski 1. The sole plate 2, the disk 5 and the sleeve 4 slide following a termination of the external force into the retracted position illustrated in FIG. 4.

The disk 5 also permits an avoiding of a lifting off of the sleeve 4 from the ski 1 or a wobbling or rattling, which could be created when no ski boot is in the binding, for example during transport of the skis.

Figure 6:
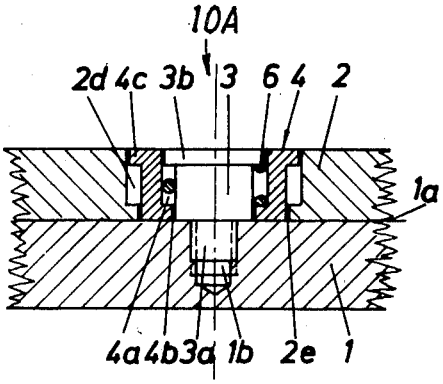
FIG. 6 illustrates the inventive telescoping pin having a spiral spring urging the parts to the illustrated retracted positions thereof.
Figure 7:
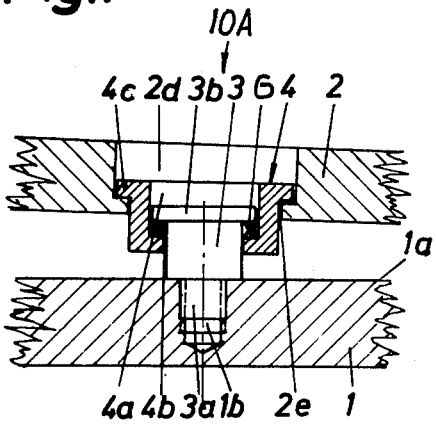
FIG. 7 illustrates the structure of FIG. 6 in the extended or operated position.

Figs. 6 and 7 illustrate a different exemplary embodiment of the inventive telescoping pin construction 10A, in which it is not necessary to use a disk 5 as is illustrated in FIGS. 1 to 5. A spiral spring 6 encircles the bolt 3 and is provided in the space between the annular flange 3*b* and the bottom wall of the recess 4*a* in the sleeve 4. The spiral spring 6 engages at one end the annular flange 3*b* of the bolt 3 any engages at its other end the bottom wall of the recess 4*a* in the sleeve 4. Since the spiral spring 6 always urges the sleeve 4 in direction toward the ski, any kind of wobbling or rattling is avoided.

FIG. 7 illustrates the structure of FIG. 6 in the retracted non-operated position. Upon a bending or flexing of the ski 1 due to the ski travelling through a depression, the structural parts behave substantially like those in the exemplary embodiment according to FIG. 5 except the spring 6 will be compressed.

The invention is not limited to the illustrated exemplary embodiment. Various modifications are conceivable, which lie by all means within the scope of the invention. For example, in place of the spiral spring it is possible to use also one or several cup springs. Furthermore, it is possible to guide the sleeve on the inside of the bolt, which bolt would have an appropriate guide hole therein.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding for use on a ski comprising a sole plate having first means thereon for fastening a ski boot thereto and second means operatively releasably coupled to the longitudinal ends of said sole plate for releasably securing said sole plate against rotation and against a lifting off from said ski, a pin means secured to said ski and extending perpendicularly with respect to the upper surface of said ski, and a recess in said sole plate receiving said pin means therein, the improvement comprising wherein said pin means includes a pin secured to said ski and a hollow sleeve movable telescopically along the length of said pin and along the length of said recess and stop means for limiting the maximum path of movement of the sleeve relative to said pin and said recess and to limit the amount of separation between said sole plate and said ski adjacent said recess and said pin when said ski is flexed into an arc.

2. The ski binding according to claim 1, wherein said stop means includes an annular flange on the free end of said pin having a diameter which is greater than the diameter of said pin and corresponds substantially with the inner diameter of said hollow sleeve, said stop means further including an inwardly projecting flange on the end of said sleeve adjacent said upper surface of said ski, the inside diameter of which corresponds substantially with the diameter of said pin, said sleeve having at its other end an outwardly projecting rim, the outside diameter of which is equal to or slightly smaller than the diameter of said recess, the inside diameter of which corresponds substantially with the outside diameter of the sleeve 3. The ski binding according to claim 1 or 2, wherein both said pin with its flange and also said sleeve with the upper surface of its outwardly projecting rim lies in the normal and unflexed condition of said sole plate in one plane with the upper surface of said sole plate.

4. The ski binding according to claim 1, wherein between said pin and said sleeve, there is arranged a spring which prevents a lifting of said sleeve from the upper surface of said ski in the normal and unflexed condition of said ski.

5. The ski binding according to claim 1 or 2, wherein said recess in said sole plate is covered on the upper side of said sole plate with a disk which has a hole therein, the central axis of which is concentric with the axis of said pin.

6. The ski binding according to claim 5, wherein upper surface of said disk is flush with the upper surface of said sole plate.

7. The ski binding according to claim 5, wherein the diameter of said hole corresponds substantially with the diameter of said flange.

8. The ski binding according to claim 5, wherein the upper end surface of said pin terminates flush with the upper surface of said disk and the upper surface of said sole plate.

9. The ski binding according to claim 5, wherein said flange on said pin lies in the normal and unflexed condition of said ski in said hole in said disk, said disk thereby preventing in this position of the ski a rattling movement of said sleeve in said recess.

* * * * *